US005309603A

United States Patent [19]

Oexler et al.

[11] Patent Number: 5,309,603

[45] Date of Patent: May 10, 1994

[54] DEVICE AND PROCESS TO COMPRESS AND GUIDE A FIBER SLIVER

[75] Inventors: Rudolf Oexler; Friedrich Hauner, both of Ingolstadt, Fed. Rep. of Germany

[73] Assignee: Rieter Ingolstadt Spinnereimaschinenbau AG, Ingolstadt, Fed. Rep. of Germany

[21] Appl. No.: 968,379

[22] Filed: Oct. 29, 1992

[30] Foreign Application Priority Data

Nov. 2, 1991 [DE] Fed. Rep. of Germany ..... 4136209

[51] Int. Cl.[5] ..... D01H 5/64

[52] U.S. Cl. ..... 19/266; 19/288; 19/157; 226/199

[58] Field of Search ..... 19/266, 288, 289, 286, 19/292, 157; 226/199

[56] References Cited

U.S. PATENT DOCUMENTS

| | | | |
|---|---|---|---|
| 2,365,322 | 12/1944 | Ashworth | 226/199 X |
| 3,269,628 | 8/1966 | Tarver | 226/199 |
| 3,323,180 | 6/1967 | Abbott | 19/288 |
| 3,823,860 | 7/1974 | Perry | 226/199 |
| 4,750,660 | 6/1988 | Kamimura | 226/199 |
| 4,925,079 | 5/1990 | Castiglioni | 226/199 X |

FOREIGN PATENT DOCUMENTS 1510450 2/1969 Fed. Rep. of Germany .

*Primary Examiner*—Clifford D. Crowder
*Assistant Examiner*—John J. Calvert
*Attorney, Agent, or Firm*—Dority & Manning

[57] ABSTRACT

The invention relates to a device to condense and guide a fiber sliver, in particular in a spinning plant preparation machine having a sliver funnel. The funnel is followed by draw-off rollers which are surrounded on both sides by guide surfaces. The lateral distances between the guide surfaces and the draw-off rollers can be adjusted independently of each other. A process is also provided according to which the distance between the guide surfaces is selected to be greater for puffed fiber material than for non-puffed fiber material. Furthermore, the distance between the guide surfaces is selected to be greater with synthetic fiber material than with natural fibers.

10 Claims, 2 Drawing Sheets

DEVICE AND PROCESS TO COMPRESS AND GUIDE A FIBER SLIVER

The instant invention relates to a device and to a process to compress and guide a fiber sliver, in particular on a spinning plant preparation machine with a sliver funnel followed by draw-off rollers and guiding surfaces surrounding the draw-off rollers on both sides.

DE-OS 15 10 450 discloses a sliver funnel letting out directly before the nip of a pair of rollers. The pair of rollers consists of a disk-shaped roller and a roller provided with a circumferential groove. The thickness of the disk-shaped roller is adapted to the circumferential groove of the other roller so that a fiber sliver clamped between the two rollers is guided laterally by the sides of the circumferential groove. In this design the relatively high expenditure required to make the roller with the circumferential groove and the high assembly cost when adjusting the rollers in relation to each other are disadvantage.

Furthermore a sliver funnel with integrated guide brackets is known from the draw frame RSB 851 of the firm Schubert & Salzer Maschinenfabrik AG. The guide brackets laterally surround a pair of draw-off rollers following the sliver funnel.

The utilization of draw-off rollers of simple design is possible thanks to the lateral guide brackets provided on the sliver funnel. However the disadvantage in this design is the fact that the support of the draw-off rollers must be aligned very precisely with the sliver funnel in order to avoid friction of the draw-off rollers against the guide brackets. In addition there is the disadvantage that different sliver funnels must be used with draw-off rollers of different widths and that the lateral distance between the guide brackets and the draw-off rollers can be adjusted only in large increments as different fiber materials with little variety in components is used.

It is the object of the instant invention to create an inexpensive device for the compression and guidance of a fiber sliver that is easily adjusted to different production tolerances or fiber materials.

This object is attained in that the lateral distances between the guide surfaces and the pair of draw-off rollers can be adjusted independently of each other. The pair of draw-off rollers may be used in a draw frame, for example. The guide surfaces can be assigned to the sliver funnel and to the pair of draw-off rollers in accordance with their respective tolerances. In this manner it is possible to adapt the guide surfaces easily to the sliver funnel and to the draw-off rollers. Friction of the draw-off rollers against the guide surface or against the sliver funnel is avoided.

The distance between the guide surfaces and the pair of draw-off rollers is advantageously adjustable by means of adjusting washers of different thicknesses and/or in different numbers. If the guide surfaces are guide brackets, the adjusting washers are placed between the guide brackets. In case of guide surfaces in form ring washers placed laterally next to the draw-off rollers the distance can be adjusted by means of adjusting washers placed between the draw-off roller and the ring washers.

In an advantageous embodiment the guide brackets are mounted on a holder of the sliver funnel. The distance between the guide brackets and the draw-off rollers can in this case be adjusted by means of adjusting washers between the guide brackets and the holder.

If the guide brackets are attached to the sliver funnel by means of a screw extending at a right angle to the running direction of the fiber sliver, simple assembly and adjustment of the guide brackets on the sliver funnel is possible. During assembly, adjusting disks are simply inserted between the holder of the sliver funnel and the guide brackets and are then pressed against each other by means of the screw. By positioning matching edges on the sliver funnel and on the guide brackets said guide brackets are sufficiently secured against rotation.

A special advantage has been shown to be the fact that when puffed fiber material is processed, better results are obtained if a greater distance is set for the guide surfaces than for non-puffed fiber material. This prevents fibers from a puffed fiber material to become caught between the guide brackets and the draw-off rollers, thus interfering with the passage of the fiber sliver through the funnel and through the draw-off rollers.

It has also shown to be an advantage to set a greater distance of the guide surfaces for synthetic fibers than for natural fibers. This prevents the fibers from being pressed too strongly against the lateral guide surfaces, thereby heating up and melting due to excessive friction. If the distance is set a few tenths of a millimeter more for synthetic fibers than for natural fibers a better processing result and gentler handling of the fibers is achieved.

Advantageous embodiments of the invention are described below.

Figure 1:
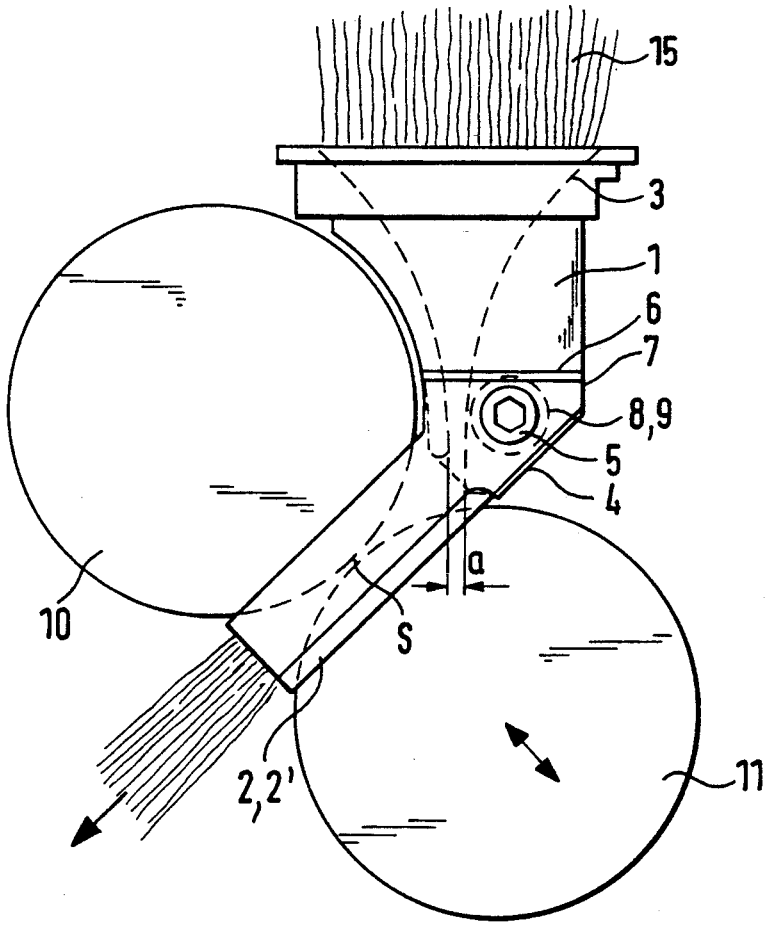
FIG. 1 shows a lateral view of a sliver funnel with guide brackets.

In FIG. 1 a sliver funnel 1 is shown with guide surfaces provided for it. The guide surfaces in this embodiment are guide brackets 2 and 2'. The guide brackets 2, 2' are attached to a holder 3 of the sliver funnel 1. The attachment is effected by means of a screw 5 pressing the guide brackets 2, 2' against the holder 4 transversely to the direction of movement of a fiber sliver 15. To prevent rotation of the guide brackets 2,2' an edge 6 of the sliver funnel 1 is paired up with an edge 7 of the guide brackets 2, 2'. The screw 5 is installed in the holder 4 in such manner that a funnel opening 3 of the sliver funnel 1 having a width a of the funnel output is not touched. In this manner an interference-free passage of the fiber sliver 15 through the sliver funnel 1 and the funnel opening 3 is ensured.

The guide brackets 2, 2' serve for lateral delimitation of a gap S between the draw-off rollers 10 and 11. The guide brackets 2, 2' prevent the fiber sliver 15 from emerging at the sides next to the draw-of rollers 10 and 11 when it comes between said draw-off rollers 10 and 11. This is especially important when the draw-off rollers 10 and 11 are used to control the thickness of the fiber sliver (see double arrow), when the cross-section of the fiber sliver 15 spreads the draw-off rollers 10 and 11 more or less far away from each other (see double arrow). With a thicker fiber sliver 15 one of the draw-off rollers 10 or 11 is moved out of alignment and a signal corresponding to the thickness of fiber sliver 15 can be obtained. Here especially it is necessary to ensure that no fiber sliver 15 may emerge laterally next to the draw-off rollers, thus causing the measured value to be different from the actual thickness of fiber sliver 15.

Adjusting washers 8 and 9 are provided between guide bracket 2, 2' and holder 4. The distance between the guide bracket 2 and the holder 4 can be adjusted by means of the adjusting washers 8 and 9 in function of the thickness of the included adjusting washers 8 and 9. The utilization of appropriate adjusting washers 8 and 9 depends according to the invention on the distances which must be kept between the guide brackets 2, 2' and the draw-off rollers 10 and 11.

Figure 2:
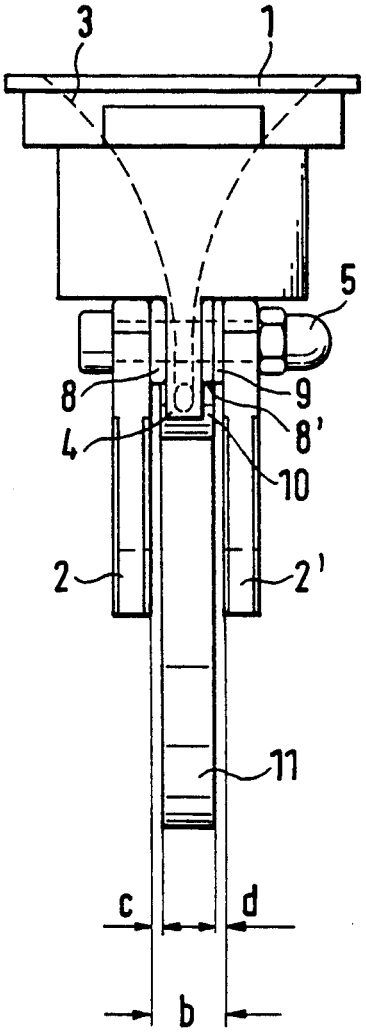
FIG. 2 shows a front view of the sliver funnel with guide brackets.

FIG. 2 shows the sliver funnel 1 in a frontal view. The guide brackets 2 and 2' are attached to the holder 4 by means of screw 5. Adjusting washers 8 and 9 are placed between the guide brackets 2 and 2' and the holder 4. The distances c and d between the guide brackets 2 and 2' and the draw-off rollers 10 and 11 or a distance b between the guide brackets can be adjusted by means of the adjusting disks 8 and 9. The adjustability of the guide brackets 2, 2' according to the invention makes it now possible to counteract play of the bearings of the draw-off rollers 10 and 11 by selecting the distance c or d between the guide brackets 2, 2' and the draw-off rollers 10 and 11 so that the draw-off rollers 10 and 11 can in no case run up against the guide brackets 2, 2'. An additional advantage consists in the fact that the assembly of the sliver funnel 1 no longer need to be carried out with as great a precision in relation to the draw-off rollers 10 and 11 as before. With the instant invention it is possible for the guide brackets 2 and 2' to be mounted on the holder 4 with appropriate adjusting washers after the assembly of the sliver funnel 1 and the draw-off rollers 10 and 11. This assembly sequence allows for simpler and therefore less expensive assembly. In addition advantages are achieved in the finishing tasks, since the surfaces of the guide brackets can be treated more easily when they are in a disassembled state than until now, on a one-piece unit consisting of sliver funnel and guide brackets.

A value of approximately 1 mm has proven to be an advantageous overall thickness for the adjusting washers 8 and 9 and thereby as a variation possibility for the distance b of the guide brackets 2, 2'.

The device according to the invention advantageously provides the possibility to carry out the adjustment of the guide brackets 2, 2' in function of the material of the fiber sliver 15 conveyed through the sliver funnel 1. It has been shown that in particular with puffed and/or synthetic fiber material, processing has been improved markedly if the distances c, d between the guide brackets 2, 2; and the draw-off rollers 10, 11 are set to be greater than for non-puffed fiber material or for synthetic fibers. In particular with puffed fiber material and with synthetic material the danger existed until now that the fibers may be caught between draw-off rollers 10, 11 and guide brackets 2, thus leading to malfunctions in the process. The adjustability according to the invention of the distance between the guide brackets 2, 2' is now possible to readjust the spinning preparation machine rapidly and easily for a different fiber material without expensive replacement of the sliver funnel and the attending great variation of particles. Furthermore this prevents advantageously the draw-off rollers to run up against the lateral surfaces, thus resulting in greater wear and to heat production. Melting of the fibers is avoided by heating up the friction of the draw-off rollers on the lateral surfaces as well as excessive friction between the fibers and the guide brackets. The operating results of the spinning plant preparation machine are thus improved considerably.

Figure 3:
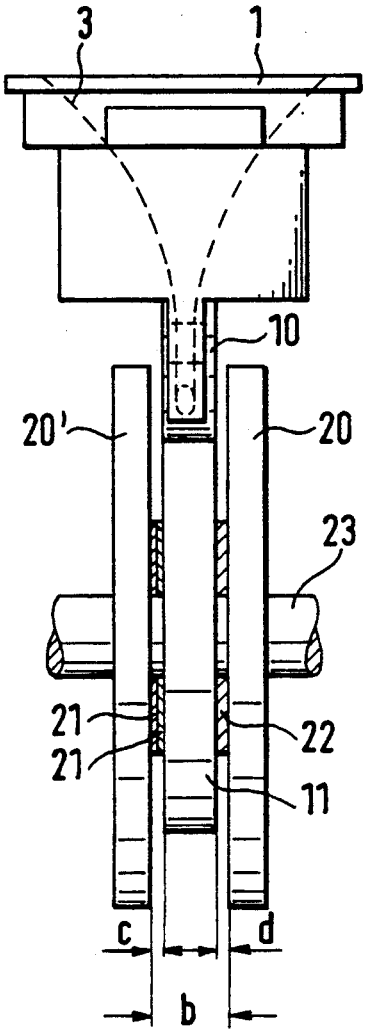
FIG. 3 shows a front view of a sliver funnel with guide disks.

FIG. 3 shows another embodiment of the invention. In this embodiment the guide surfaces are located laterally on the draw-off roller 11. The draw-off roller 11 and guide washers 20 and 20' provided on it are attached on a shaft. Adjusting washers 21 and 22 are placed between the guide washers 20 and 20' and the draw-off roller 11. As already described in FIGS. 1 and 2, the lateral guidance of the fiber sliver 15 can be adjusted by means of the adjusting washers. The guide washers 20 and 20' are always capable of being adapted in relation to the draw-off roller 10 and the outlet of the funnel opening 3 of the sliver funnel 1. The guide washers 20, 20' rotate together with the draw-off roller 11 in this embodiment.

The invention covers of course also an embodiment in which the guide surface is attached on a separate support, independent of the sliver fiber or of the draw-off roller and in which the lateral distance from the draw-off rollers can be adjusted.

We claim:

1. A fiber sliver compression and guiding device for use with a textile plant sliver preparation machine, the sliver preparation machine having a sliver funnel and draw-off rollers downstream of the funnel, said device comprising guide surfaces on both sides of the draw-off rollers and disposed at predetermined lateral distances from the respective surfaces of said draw-off rollers; and means for independently varying the lateral distances between each guide surface and the draw off rollers.

2. The compression and guiding device as in claim 1, wherein said varying means comprises at least one adjusting washer disposed between at least one guide surface and the draw-off rollers.

3. The compression and guiding device as in claim 2, further comprising a plurality of said adjusting washers, wherein any combination of said washers are disposed between said guide surfaces and the draw-off rollers.

4. The compression and guiding device as in claim 3, wherein said adjusting washers are of varying thickness.

5. A device for compressing and guiding fiber sliver comprising:

a sliver funnel;

draw-off rollers operatively disposed downstream from said sliver funnel;

guiding brackets on each side of said draw-off rollers generally covering the nip of said draw-off rollers;

at least one adjusting washer between at least one of said guiding bracket and said sliver funnel for varying the lateral distance between said guiding brackets and said draw-off rollers; and a bolt member disposed at a right angle to the running direction of the sliver fiber, said bolt member securing said guiding brackets, said adjusting washers, and said sliver funnel relative each other.

6. A process for compressing and guiding fiber sliver said process comprising the steps of drawing the fiber through a sliver funnel by draw-off rollers covered by guiding surfaces, and independently varying the lateral distance between each guiding surface and the draw-off rollers.

7. The process as in claim 6, further comprising the step of determining the puff characteristics of the fiber sliver material and varying the lateral distance between the guiding surfaces and the draw-off rollers as a function of the puff characteristics of the fiber material, by increasing the lateral distance with a puffed fiber material and decreasing the lateral distance with a non-puffed fiber material.

8. The process as in claim 6, further comprising the step of determining the synthetic fiber content of the fiber sliver material and varying the lateral distance between the guiding surfaces and the draw-off rollers as a function of the synthetic fiber content of the fiber material, by increasing the lateral distance with fiber material having a greater content of synthetic fibers.

9. A fiber sliver compression and guiding device for use with a textile plant sliver preparation machine, the sliver preparation machine having a sliver funnel and draw-off rollers downstream of the funnel, said device comprising guide surfaces on both sides of the draw-off rollers and disposed at predetermined lateral distances from the perspective surfaces of the draw-off rollers; and means for independently varying the lateral distance between each guide surface and the draw-off rollers, said guide surfaces comprising guide brackets mounted on a holder for the sliver funnel and secured against rotation relative thereto, said varying means comprising at least one adjusting washer disposed between at least one said guide bracket and said sliver funnel.

10. A fiber sliver compression and guiding device for use with a textile plant sliver preparation machine, the sliver preparation machine having a sliver funnel and draw-off rollers downstream of the funnel, said device comprising guide surfaces on both sides of the draw-off rollers and disposed at predetermined distances from the respective surfaces of said draw-off rollers; and means for independently varying the lateral distance between each guide surface and the draw-off rollers, said guide surfaces comprising guide brackets mounted on a holder for the sliver funnel and secured against rotation relative thereto, said guide brackets mounted relative to the sliver funnel by a screw device which is at a right angle to the running direction of the fiber sliver, said varying means comprising at least one adjusting washer disposed between at least one said guide bracket and said sliver funnel.

* * * * *